US005425250A

United States Patent [19]

Hutchison et al.

[11] Patent Number: 5,425,250

[45] Date of Patent: Jun. 20, 1995

[54] RECEIVER/DRYER

[75] Inventors: Wayne K. Hutchison, Ingersoll; William N. Eybergen, Dutton, both of Canada

[73] Assignee: Eaton Corporation, Cleveland, Ohio

[21] Appl. No.: 201,828

[22] Filed: Feb. 25, 1994

[51] Int. Cl.[6] ..... F25B 39/04

[52] U.S. Cl. ..... 62/474; 62/509

[58] Field of Search ..... 62/509, 503, 474

[56] References Cited

U.S. PATENT DOCUMENTS

| | | | |
|---|---|---|---|
| 4,888,962 | 12/1989 | Harper et al. | 62/503 |
| 4,920,766 | 5/1990 | Yamamoto et al. | 62/509 X |
| 4,993,455 | 2/1991 | Yawagisawa | 62/509 X |
| 5,191,775 | 3/1993 | Shiina et al. | 62/503 |

*Primary Examiner*—William E. Wayner

*Attorney, Agent, or Firm*—Roger A. Johnston

[57] ABSTRACT

A receiver/dryer assembly for a refrigeration system formed of a drawn aluminum canister having desiccant material contained in a basket secured to an aluminum header welded to the canister. An inlet port is provided in the header and an outlet tube is received through the desiccant basket and is attached to a central outlet port in the header. An inlet tube has an annular convolution formed on one end with an apertured attachment block bearing against the convolution on one side to compress a seal ring on the opposite side for sealing the tube over the inlet port, and the block is fastened to the header with a cap screw. A pair of aluminum studs are welded to the outside of the canister and a retaining bracket received over studs and retained by nuts threaded on the studs.

10 Claims, 3 Drawing Sheets

RECEIVER/DRYER

BACKGROUND OF THE INVENTION

The present invention relates to receptacles of the type known as receiver/dryers for refrigeration systems and particularly air conditioning systems employed for cooling vehicle passenger compartments. Vehicle air conditioning systems typically employ a receptacle containing a desiccant for condensing water from the refrigerant as the liquid refrigerant is discharged from the main condenser on the high pressure side of the system prior to expansion and flow to the system evaporator. In typical receiver/dryer applications for vehicle air conditioning systems, the system high side pressure is on the order of 350 psi (2400 kPA) and thus the connections to and from the receiver/dryer have proven to be critical in maintaining long term system integrity in view of the relatively high refrigerant pressure in the receiver/dryer. This is particularly troublesome where it is desired to have quick connects for ease of installation in automotive mass production.

Heretofore, receiver/dryers have been formed of steel with a mounting bracket welded thereto for attachment in the vehicle. However, it has been desired to reduce the weight of vehicle components and thus recent designs have concentrated on manufacturing the receiver/dryer of aluminum. However, where aluminum has been employed for the receiver/dryer, mounting of the assembled unit into the vehicle and attachment of conduits to the inlet and outlet thereof have proven difficult at assembly and problems have arisen in maintaining the security of the mounting and the pressure sealing integrity of the conduit connections over the service life of the vehicle.

Heretofore, it has been a practice in vehicle air conditioning systems employing receiver/dryers formed of aluminum to provide a clamping band about the body of the receiver/dryer for attachment thereto. Another technique employed heretofore with aluminum receiver/dryers has been that of welding an aluminum bracket to the receiver/dryer shell or housing. Where it has been desired to remove the receiver/dryer for service in the field, it has been extremely difficult to provide access to the bracket attachment to the vehicle for ready removal after installation of the system is complete. Furthermore, where an aluminum bracket is welded, such as by tungsten inert gas techniques, problems have been encountered in heat distribution during weldment resulting in burning through the wall of the housing or shell during the bracket welding operation.

It has thus been desired to provide a receiver/dryer for a vehicle air conditioning system which is light in weight, easy to manufacture, and easily installed in the vehicle, and readily connected to the evaporator inlet and the condenser outlet.

SUMMARY OF THE INVENTION

The present invention comprises a receiver/dryer assembly for an automotive vehicle air conditioning system having a canister formed of drawn aluminum with a header having an inlet and an outlet port welded over the open end of the cup-shaped canister which has desiccant contained therein. An inlet tube has an annular convolution formed adjacent one end with a mounting block received over the tube and fastened to the header by a threaded fastener which seals the tube convolution over the header inlet port. The opposite end of the inlet tube has an annular convolution formed thereon with an attachment block received over the end of the tube with portions thereof deformed over the convolution to retain the block on the tube end.

The canister has a pair of threaded studs welded to the exterior thereof and extending outwardly therefrom in generally spaced parallel arrangement. A mounting bracket is secured over the studs by engagement with fasteners such as retaining nuts threaded over the studs. The receiver/dryer of the present invention is thus easy to manufacture, light in weight, and readily installed in the vehicle, and connected to the evaporator inlet and condenser outlet with a minimum of difficulty.

DETAILED DESCRIPTION

Figure 1:
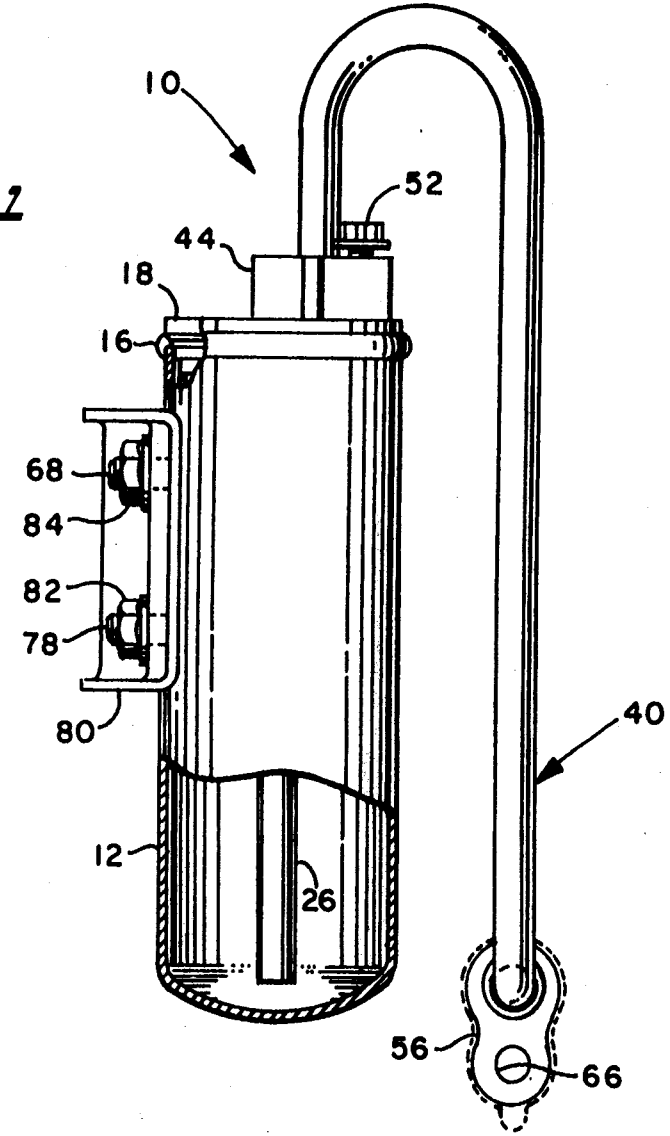
FIG. 1 is a front elevation view of the receiver/dryer assembly of the present invention.
Figure 5:
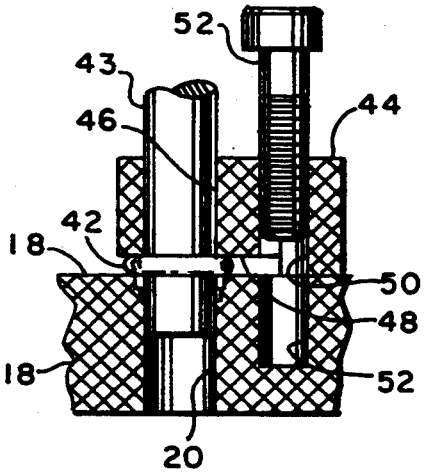
Figure 4:
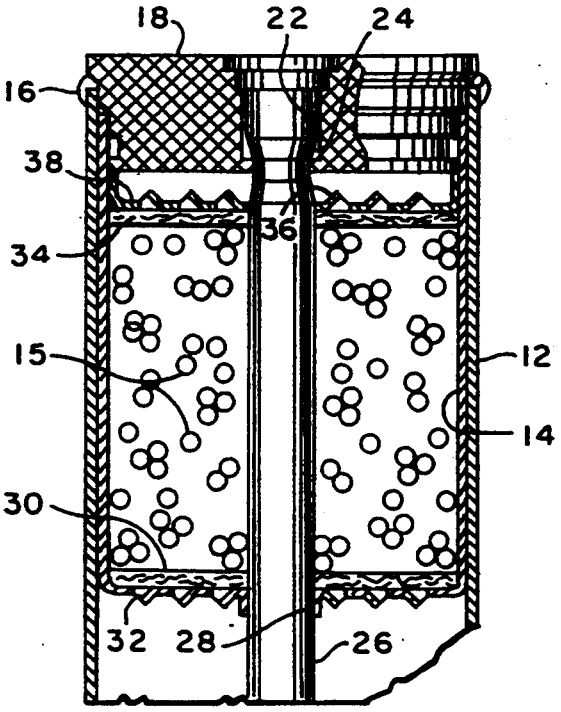
FIG. 4 is a cross-section of the canister of the assembly of FIG. 1 showing the desiccant containment and weldment of the header; and, FIG. 5 is a cross-sectional view of the mounting of the inlet tube to the header of the assembly of FIG. 1; and, FIG. 6 is a portion of a view similar to FIG. 1 illustrating an alternate embodiment of the mounting.

Referring to FIGS. 1–4, the assembly of the present invention as indicated generally at 10 as having a generally cup-shaped deep drawn aluminum canister 12 which has an aluminum header with a desiccant receiving cup or basket 14 attached to a reduced diameter portion thereof and received within the canister 12; and, the header is welded to the canister about the open end thereof in a bead as denoted by reference numeral 16. The header 18 has an inlet port 20 (see FIG. 5) formed therein and a centrally disposed outlet port 22 which outlet port has one end of stand pipe 26 attached thereto by flaring as denoted by reference numeral 24. The tube 26 extends downwardly into the canister through a central aperture 28 formed in the desiccant basket to a position adjacent the closed end of the canister as shown in FIG. 1.

Typically, the desiccant has a layer of filter material 30, provided adjacent the perforations 34 in the bottom of the basket 14 and a layer 36 adjacent the perforated retaining plate 38 provided at the upper end of the basket 14.

Referring to FIGS. 1, 2, 3 and 5, an inlet tube subassembly indicated generally at 40 includes tube 43 which has one end thereof provided with a bulge or annular convolution 42. Subassembly 40 includes a mounting block 44 with an aperture 46 formed therein which has the tube 43 received therethrough such that the side of block 44 is registered against the axial face of the convolution 42 which is remote from the end of the tube 43. Block 44 has a second aperture 50 parallel with and spaced from aperture 46 and through which is received a threaded fastener 52 which in the presently preferred practice is a cap screw which threadedly engages a bore 52 formed in header 18. The opposite end of tube 43 from the convolution 42 has provided thereon another annular convolution 54 which has registered thereagainst an attachment block 56 which has a bore 58 therein received over the end of the tube 43. The attachment block 56 has an annular portion 60 thereof deformed over the convolution 54 to retain the block 56 against the convolution. Block 56 has a projection or boss 62 formed on the side thereof opposite convolution 54 which boss has a seal ring 64 provided thereon and is adapted for connection to the inlet of the refrigeration system evaporator. Block 56 has an aperture 66 provided therein generally parallel to and spaced from the aperture 58; and, aperture 66 is adapted for receiving therethrough a suitable fastening means for securing the connection to a condenser outlet (not shown).

Figure 2:
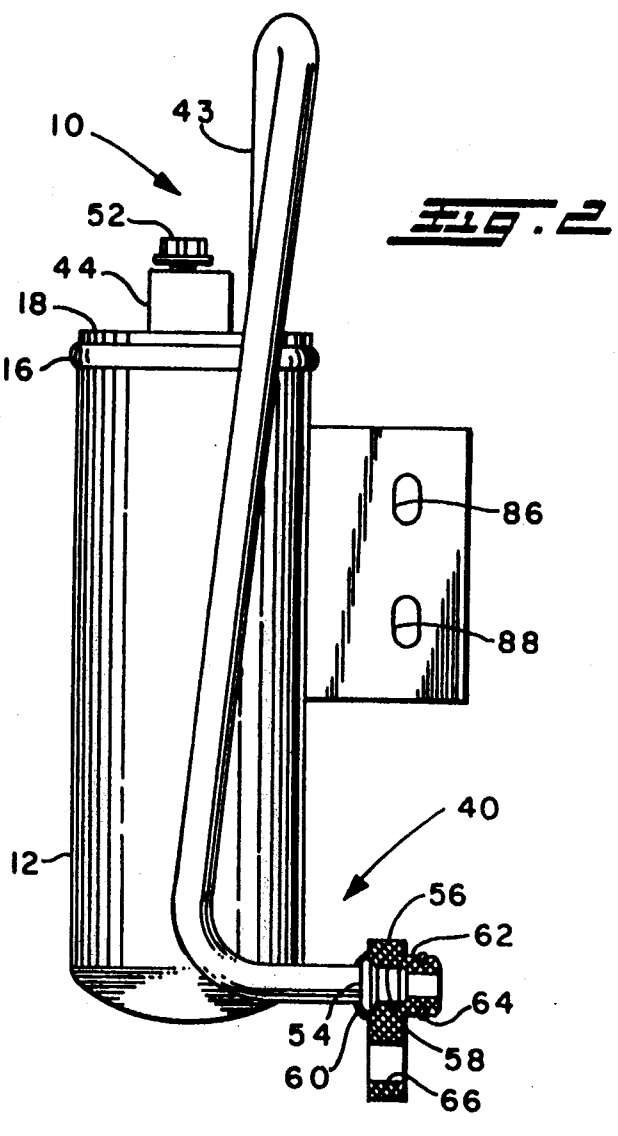
FIG. 2 is a left side elevation of the assembly of FIG. 1.
Figure 3:
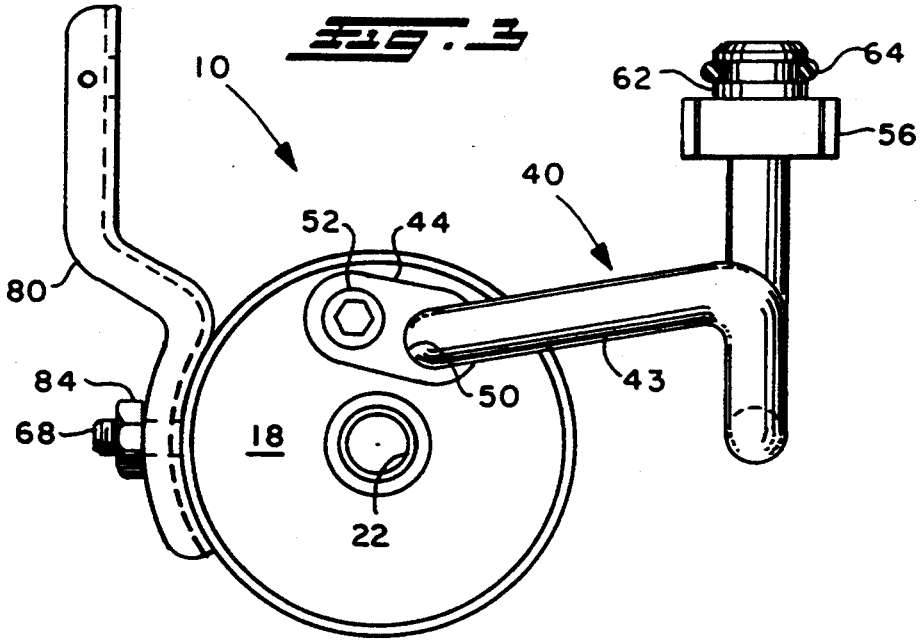
FIG. 3 is a top plan view of the assembly of FIG. 1.

Referring to FIGS. 1, 2 and 3, canister 12 has welded to the exterior thereof a pair of threaded aluminum studs 68,78 which extend radially outwardly therefrom in spaced parallel relationship. A mounting bracket 80 has a pair of correspondingly spaced apertures therein which permit the bracket 80 to be received over the studs 68,78 and to register against the outer surface of the canister 12. The bracket is retained on the canister by suitable retainers received over the studs which in the present practice of the invention comprise threaded nuts 82,84. Bracket 80 has provided on the outer flange thereof a pair of spaced apertures 86,88 which are adapted for receiving fasteners therethrough to attach the bracket to suitable mounting structure typically provided in a vehicle adjacent the system evaporator (not shown).

Figure 6:
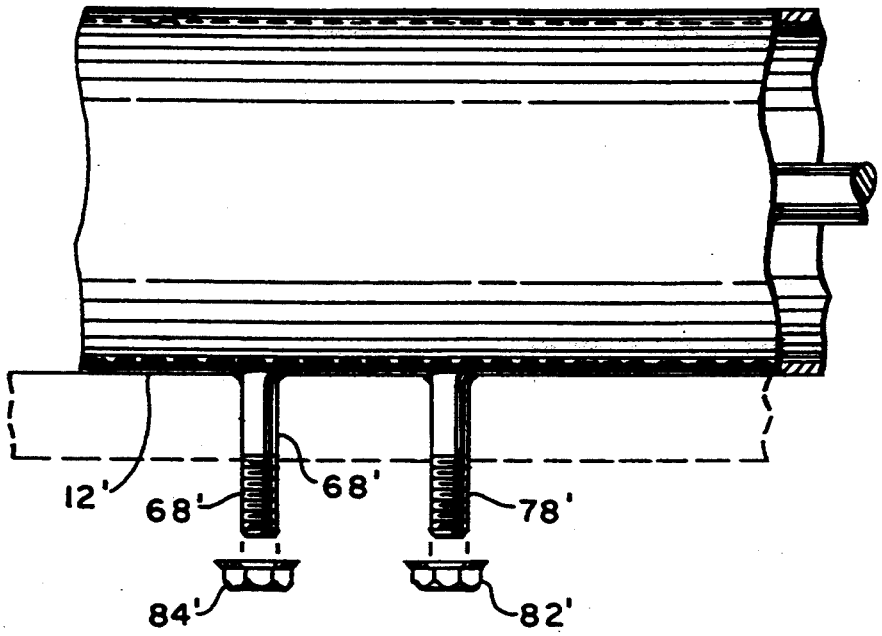

Referring to FIG. 6, an alternate embodiment is illustrated having the canister 12' provided with a plurality of spaced studs 68', 78' attached to the outer surface of the canister by weldment. The studs are adapted to be received through a desired structure to which the canister is to be attached as shown in dashed outline in FIG. 6; and, suitable retaining means such as threaded nuts 82', 84' are engaged over the studs to retain the canister to the mounting structure.

The present invention thus provides a lightweight, low cost, easy to assemble means for mounting and connecting to a receiver/dryer for a refrigeration or air conditioning system. The receiver/dryer assembly of the present invention is particularly suitable for air conditioning systems employed in motor vehicles.

Although the invention hereinabove has been described with respect to the illustrated embodiments, it will be understood that the invention is capable of modification and variation and is limited only by the following claims.

We claim:

1. A dryer assembly for pressurized liquid refrigerant comprising:

(a) a generally thin-walled cup shaped canister formed of non-magnetic material having a header attached to the open end thereof, said header having an inlet and outlet port formed therein and said canister containing a desiccant therein;

(b) an inlet tube having one end attached to said header inlet port and said tube having a mounting block means attached to the end opposite said one end, said block having a cut-out for receiving therein a fastening means;

(c) a plurality of threaded studs attached by weldment to the exterior of said canister and extending therefrom in spaced arrangement; and, (d) a mounting bracket having cut-outs therein corresponding to the spacing of said studs, said bracket received thereover and secured against said canister by retaining means to engaging said studs.

2. The assembly defined in claim 1, wherein said inlet tube has an attachment block attached to said one end with said block secured to said header by a threaded fastener, wherein said block is sealed about said inlet port.

3. The assembly defined in claim 1, wherein said canister, said header, said inlet tube, said mounting block and said studs are formed of aluminum.

4. The assembly defined in claim 1, wherein said bracket is formed of aluminum.

5. The assembly defined in claim 1, wherein said mounting block means is attached to said inlet tube by deformation of portions of said block means.

6. The assembly defined in claim 1, wherein said inlet tube has an attachment to said one end, said attachment block being secured to said header by threaded fastener.

7. The assembly defined in claim 1, wherein said inlet tube mounting block means has a cut-out formed therein and has a boss extending therefrom having a sealing ring thereon and adapted for insertion into a connector port.

8. The assembly defined in claim 1, wherein said one end of said tube has a convolution formed adjacent thereto and has an attachment block received on said tube and bearing against said convolution, said attachment block secured to said header by threaded fastening means.

9. The assembly defined in claim 1, wherein said mounting block means is attached to said end opposite said one end by annular deformation of the material thereof over a convolution formed on said tube.

10. A dryer assembly for pressurized liquid refrigerant comprising:

(a) a generally thin-walled cup shaped canister formed of non-magnetic material having a header attached to the open end thereof, said header having an inlet and outlet port formed therein and said canister containing a desiccant therein;

(b) an inlet tube having one end attached to said header inlet port and said tube having a mounting block means attached to the end opposite said one end, said block having a cut-out for receiving therein a fastening means;

(c) a plurality of threaded studs attached by weldment to the exterior of said canister and extending therefrom in spaced arrangement; and, (d) retaining means engaging each of said studs for attaching said assembly to a desired structure.

* * * * *